US005468255A

United States Patent [19]

Zauns-Huber et al.

[11] Patent Number: 5,468,255

[45] Date of Patent: Nov. 21, 1995

[54] USE OF NONIONIC ORGANIC DIALKYL COMPOUNDS FOR PREVENTING FATTY SPEW ON LEATHER

[75] Inventors: Rudolf Zauns-Huber, Duesseldorf; Emil Ruscheinsky, Leverkusen; Fredi Wolter, Moenchengladbach, all of Germany

[73] Assignee: Henkel Kommanditgesellschaft auf Aktien, Duesseldorf, Germany

[21] Appl. No.: 373,317

[22] PCT Filed: Jul. 10, 1993

[86] PCT No.: PCT/EP93/01807

§ 371 Date: Feb. 17, 1995

§ 102(e) Date: Feb. 17, 1995

[87] PCT Pub. No.: WO94/02649

PCT Pub. Date: Feb. 3, 1994

[30] Foreign Application Priority Data

Jul. 18, 1992 [DE] Germany ..... 42 23 704.1

[51] Int. Cl.[6] ..... C14C 9/00

[52] U.S. Cl. ..... 8/94.22; 8/94.23; 8/94.33; 8/94.18; 252/8.57

[58] Field of Search ..... 8/94.22, 94.23, 8/94.33, 94.18; 252/8.57; 427/389

[56] References Cited

U.S. PATENT DOCUMENTS

| | | | |
|---|---|---|---|
| 2,158,627 | 5/1939 | Kritchevsky | 8/94.18 |
| 2,322,959 | 6/1943 | West | 8/94.33 |
| 3,749,669 | 7/1973 | Luvisi et al. | 252/8.57 |
| 3,770,372 | 11/1973 | Luvisi et al. | 8/94.23 |
| 3,971,626 | 7/1976 | Heyden et al. | 8/94.23 |
| 4,780,222 | 10/1988 | Amati | 252/8.57 |
| 4,919,923 | 4/1990 | Hoeffkes et al. | 424/70 |

FOREIGN PATENT DOCUMENTS

| | | |
|---|---|---|
| 2249953 | 5/1975 | France . |
| 2250866 | 4/1973 | Germany . |
| 7111361 | 7/1982 | Japan . |
| 0336154 | 3/1959 | Switzerland . |
| 2163451 | 2/1986 | United Kingdom . |
| 9015127 | 12/1990 | WIPO . |

OTHER PUBLICATIONS

W. Fahricon, Chem. Umschau, 1917, 29 (Month Unknown).
B. Kohnstein, Collegium 1913, 68, (Month Unknown).
C. Riess, Collegium 1926, 419 (Month Unknown).
A. Pankhurst, R. G. Mitton, R. F. Innes, W. Johnson, Journal of International Society of Leather Trade Chemists 1952, 379 (Month Unknown).
O. Grimm, Österr. Lederzeitung 1954, 253 (Month Unknown).
O. Hagen, Schweiz, Ledertechn.. Rundsch. 1949, 1 (Month Unknown).
"Bibliothek des Leders"; vol. 4: Entfetten, Fetten under Hydrophobieren bei der Lederherstellung (Defatting, Oiling and Hydrophophobicizing in Leather Manufacture); pp. 116–136) (Date Unknown).
Das Leder, 1983 [34] 181–185 (Month Unknown).
F. Stather, "Gerbereichemie und Gerbereitechnologie", Berlin 1967, p. 740 (Month Unknown).
A. Gluszcak, K. J. Bienkiewicz, Przegl.Skorzany 1985, 40(11–12), 232 (Month Unknown).
Przegl. Skorzany 42(2), 35; (Month Unknown).
"Das Leder" 1989, p. 256 (Date Unknown).

*Primary Examiner*—Stephen Kalafut
*Assistant Examiner*—Alan D. Diamond
*Attorney, Agent, or Firm*—Ernest E. Szoke; Wayne C. Jaeschke; Real J. Grandmaison

[57] ABSTRACT

The present invention relates to a fatty spew inhibiting composition for leather comprising an oiling component in combination with a dialkyl ether additive corresponding to general formula II:

$$R^3—O—R^4 \quad (II)$$

wherein $R^3$ and $R^4$, independently of one another represent an alkyl group containing 1 to 32 carbon atoms, the alkyl group being saturated or unsaturated, linear or branched, and the dialkyl ether additive having a total number of carbon atoms per ether molecule in the range from 14 to 36.

12 Claims, No Drawings

USE OF NONIONIC ORGANIC DIALKYL COMPOUNDS FOR PREVENTING FATTY SPEW ON LEATHER

This application is a 371 of PCT/EP93/01807 filed Jul. 10, 1993.

BACKGROUND OF THE INVENTION

1. Field of the Invention

This invention relates to the use of special nonionic organic dialkyl compounds for preventing fatty spew on leather.

2. Discussion of Related Art

Apart from tanning agents, oiling preparations are the most important auxiliaries for developing the character of leather. Oiling preparations develop their effect by lubricating and thus insulating the leather fibers and by hydrophobicizing the fibers. Coating the leather fibers with a fatty film reduces mutual friction and, hence, improves the suppleness and elasticity of the tissue. This has positive effects on the tear strength of leather because, in an elastic material, many fibers on exposure to tensile stress align themselves in the direction in which the stress is applied and, in doing so, offer greater resistance to tearing than the same fibers in a brittle material.

Leather oiling preparations are generally vegetable and animal oils, fats and waxes, the hydrolysis, sulfonation, oxidation and hydrogenation products obtained from these materials by chemical transformation and, finally, mineral oiling preparations; more specifically:

Saponifiable fats and oils and natural waxes and resins belong to the esters. To the leather expert, oils and fats are understood to be esters of glycerol and fatty acids which are solid or liquid at room temperature. From the group of animal fats, train oils, fish oil, beef tallow and neat's foot oil in particular are used for oiling leather; from the group of vegetable fats, castor oil, rapeseed oil and linseed oil in particular are used. In waxes and resins, the fatty acids are esterified with relatively high molecular weight alcohols instead of glycerol. Examples of waxes are beeswax, Chinese wax, carnauba wax, montan wax and wool grease; the most important resins include colophony, birch bark oil and shellac.

The chemical transformation of vegetable and animal fats gives products which are soluble in water and which, in addition, have an emulsifying effect to varying degrees on water-insoluble fats. Known products of this type are, for example, the sulfonated water-soluble oils of various kinds, train oils modified by oxidation (known as Dégras or Moellon), the soaps obtained in the hydrolysis of natural fats, hydrogenated fats and, finally, free fatty acids and also stearic acid as hot-stuffing fats. Most animal and vegetable fats have a certain affinity for leather which can be considerably increased by the introduction or exposure of hydrophilic groups.

Mineral oiling preparations are also important in the manufacture of leather. These hydrocarbons are similar to natural fats and oils in some properties, but cannot be saponified. They are fractions from the distillation of petroleum which are called mineral oil in liquid form, vaseline in paste-like form and paraffin in solid form.

In many cases, however, unwanted stains are formed with time on the surface of the tanned and oiled leather. This phenomenon is known as fatty spew. Fatty spew is formed mainly on chrome-tanned leathers after relatively short or prolonged storage as a white, often bloom-like coating which covers the surface of the leather either locally or completely. The spew is attributable to the egression of solid fats from the leather. It can be caused by the natural fat basically present in the leather or by fats which have been introduced into the leather during the oiling process.

Fatty mixtures used for oiling leather tend to cause fatty spew in particular when they contain large quantities of free fatty acids. Free fatty acids generally have a higher melting point than their glycerides. The hydrolysis of fats during storage of the leather correspondingly increases the danger of fatty spew (cf. B. Kohnstein, Collegium 1913, 68; W. Fahrion, Chem. Umschau 1917, 29), although the fatty spew need not consist solely of free fatty acids. Hydroxyfatty acids can also cause fatty spew (C. Rieβ, Collegium 1926, 419).

Soaps and fat liquors are hydrolyzed in chrome leather with release of fatty acids, especially in chrome leather which has not been sufficiently deacidified. Sulfonated oils and fats differ in their tendency to form fatty spew, the tendency to form fatty spew generally decreasing with longer life (A. Pankhurst, R. G. Mitton, R. F. Innes, N. Johnson, Journal of International Society of Leather Trades Chemists 1952, 379).

Fatty spew occurs more easily, the more fats with a tendency towards fatty spew which the leather contains. The quantity, composition and position of the fatty mixture of natural fat and fat liquor present in the leather critically determine the extent and the composition of the spew (cf. O. Grimm, Österr. Lederzeitung 1954, 253). Leather with a loose structure is less likely to form fatty spew than leather with a dense fiber structure. Fatty spew is observed more commonly at low temperatures than at relatively warm outside temperatures.

The crystalline fatty spew develops in the hair follicles and glandular channels, small crystals initially being formed low down and gradually filling the entire hair follicle as relatively large fatty crystals, spreading over the surface of the leather and matting together to form a dense crystal film. Any fats containing stearic or palmitic acid derivatives can cause crystalline fatty spew, the danger of spew formation increasing with increasing concentration (cf. O. Hagen, Schweiz, Ledertechn. Rundsch. 1949, 1).

So-called neutral fats, i.e. substances suitable for oiling leather which do not contain any ionic groups in the molecule, for example fats, waxes and hydrocarbons, have a particular tendency to form fatty spew. Neutral fats in the form of stearic and/or palmitic derivatives, for example corresponding triglycerides, are particularly critical in this regard. Particular significance attaches to neutral fats in the case of leather chrome-tanned by the so-called fat liquor process. A fat liquor typically contains around 20 to 40% by weight of an emulsifier and 60 to 80% by weight of a neutral fat. In the leather-processing industry, it is common practice to use neutral fats which can readily be sulfated for oiling tanned leather. If, for example, a triglyceride is reacted with less than the equivalent quantity of concentrated sulfuric acid or oleum, the reaction mixture obtained may be directly used as a fat liquor because it contains on the one hand an emulsifier in the form of the sulfated triglyceride and, on the other hand, the neutral fat in the form of the unreacted triglyceride. Specific reference is made in this regard to the Examples of the present application.

In addition to the use of oiling preparations from the group of neutral fats, the natural fats already present in leather play a significant part in the formation of fatty spew.

Sebum consists of a mixture of lipids of different composition of which the type and proportions are shown in Table 1 for a few important animal species (cf. Martin Hollstein, "Bibliothek des Leders"; Vol. 4: Entfetten, Fetten und Hydrophobieren bei der nederherstellung (Defatting, Oiling and Hydrophobicizing in Leather Manufacture); pages 116–136). It is clear from Table 1, that, in quantitative terms, the triglycerides are the most important group of skin lipids. From the point of view of the leather expert, a particularly critical factor in connection with the formation of fatty spew is that these triglycerides are based for the most part on saturated fatty acids: lauric acid, myristic acid, palmitic acid and stearic acid are typical units within this group. The wax esters also contain inter alia these particularly critical fatty acids as units.

TABLE 1

Composition of the total lipids of the skin of various animal species (in %, based on total lipid of the fresh skin)

| Lipid | Animal species | | |
|---|---|---|---|
| | Cow | Goat | Sheep |
| Triglycerides | 53 | 68 | 56 |
| Wax esters | 11 | 12 | 23 |
| Phospholipids | 1 | 8 | 6 |
| Cholesterol | 4 | 8 | 5 |
| Free fatty acids | 0 | 4 | 5 |
| Hydrocarbons | 1 | — | — |

Accordingly, it is clear that the natural fat already present in leather represents a constant latent potential for the formation of fatty spew. In addition, it is known that the natural fat content of the raw material has remained consistently high over the past 10 years. According to Ernst Pfleiderer, the reason for this lies in the changing methods used to breed and feed cattle. The leather-processing industry has complained for years about the increased fat content in major skin provenances, calf skins and pig skins (cf. Das Leder, 1983 [34] 181–185).

Pfleiderer's comments were confirmed in our own exploratory studies on limed and skived cowhides. Natural fat contents of up to 8% and higher were found in the belly parts.

Accordingly, leather with a high natural fat content requires special measures to suppress its tendency to form fatty spew. For example, it is possible and quite common in practice to defat the leathers accordingly, although this does involve a special process step. Other possibilities are almost meaningless for practical purposes.

Fatty spew, which can be clearly distinguished from mineral spew by its disappearance on heating with a burning match, can be removed for example by rubbing the leather with a cloth soaked in spirit. To prevent the subsequent reformation of spew, it has been recommended to oil the grain with a neutral mineral oil (cf. F. Stather, "Gerbereichemie und Gerbereitechnologie", Berlin 1967, page 740). A. Gluszcak and K. J. Bienkiewicz report on the use of a mixture of wood dust, water, hexane and tetrachloromethane for removing fatty spew (cf. Przegl. Skorzany 1985, 40(11–12), 232; reported in Chem. Abstracts 105(6):45160e).

The formation of fatty spew on commercial clothing and glove leather observed over a period of 2 to 4 weeks could be prevented by the use of glutaraldehyde in the tanning process or by using a fat liquor containing mineral oil (cf. A. Gluszcak, K. J. Bienkiewicz, Przegl. Skorzany 1985, 40(11–12), 232; reported in Chem. Abstracts 105(6):45160e). However, Gluszcak and Bienkiewicz's method has the disadvantage that it is confined to a special tanning method. However, it does not apply to chrome-tanned leathers which still represent by far the highest percentage of all commercial leathers.

However, since oiling is in any event an almost essential step after tanning in the processing of leather in order to achieve the required product properties, it has become common practice to use special synthetic oiling preparations with only a minimal tendency to form fatty spew.

A class of oils which have been widely used for this purpose are halogenated compounds, such as chlorinated hydrocarbons. Unfortunately, the increasingly more stringent ecological and toxicological requirements which products entering the environment or coming into contact with the consumer are expected to satisfy make this class of compounds increasingly unattractive. The use of chlorinated paraffins as additives for fat liquor emulsions to prevent the formation of fatty spew on chrome-tanned pig skin is described, for example, by J. Golonka (Przegl. Skorzany 42(2), 35; reported in Chem. Abstracts 107(18):156865z).

On the whole, therefore, the methods for preventing fatty spew known from the prior art are unsatisfactory.

It is clear from the foregoing context that there is a continuing need in the leather industry for additives and oiling preparations which effectively prevent fatty spew in order thus to extend the range of commercial products and to be able to respond flexibly to changing market requirements. Above all, there is a need for ecologically and toxicologically safe additives and oiling preparations which, in their practical application, do not lead to the unwanted formation of fatty spew.

DESCRIPTION OF THE INVENTION

It has now been found that certain compounds corresponding to general formulae (I) or (II) effectively satisfy the above-mentioned requirements in every respect and may be used with advantage as fatty spew inhibiting additives in the oiling of leather.

Accordingly, the present invention relates to the use of nonionic organic dialkyl compounds for preventing fatty spew on leather, characterized in that nonionic organic dialkyl compounds which have a pour point below 6° C. and which are selected from the group consisting of (a) fatty acid esters corresponding to general formula (I):

$$R^1—COO—R^2 \quad (I)$$

in which $R^1$ is an alkyl group containing 7 to 21 carbon atoms and $R^2$ is an alkyl group containing 1 to 22 carbon atoms, the alkyl groups optionally being saturated or unsaturated, linear or branched, with the proviso that at least one of the substituents $R^1$ or $R^2$ is unsaturated and/or branched and the total number of carbon atoms per ester molecule is in the range from 14 to 36, and/or (b) dialkyl ethers corresponding to general formula (II):

$$R^3—O—R^4 \quad (II)$$

in which $R^3$ and $R^4$ independently of one another represent an alkyl group containing 1 to 32 and, more particularly, 7 to 22 carbon atoms, the alkyl groups optionally being saturated or unsaturated, linear or branched, with the proviso that the total number of carbon atoms per ether molecule is in the range from 14 to 36, are used in the oiling of leather.

Examples of suitable fatty acid esters (I) are isopropyl myristate, isopropyl palmitate, isopropyl stearate, isopropyl oleate, n-butyl stearate, n-hexyl laurate, n-decyl oleate, isooctyl stearate, isononyl palmitate, isononyl isononanoate, 2-ethylhexyl palmitate, 2-ethylhexyl laurate, 2-hexyldecyl stearate, 2-octyldodecyl palmitate, 2-ethylhexyl oleate, i-butyl oleate, oleyl oleate, oleyl erucate, erucyl oleate and esters obtainable from technical aliphatic alcohol mixtures and technical aliphatic carboxylic acids, for example esters of saturated and unsaturated fatty alcohols containing 12 to 22 carbon atoms and saturated and unsaturated fatty acids containing 12 to 22 carbon atoms which are obtainable from animal and vegetable fats. Naturally occurring monoester or wax ester mixtures of the type present, for example, in jojoba oil or in sperm oil are also suitable.

In one preferred embodiment, the nonionic organic dialkyl compounds are selected from the group of fatty acid esters (I) which have a pour point below −10° C. Fatty acid esters in which the total number of carbon atoms per ester molecule is in the range from 20 to 30 are particularly suitable.

According to the invention, fatty acid esters (I) with a pour point below −10° C. in which $R^2$ is a branched $C_{4-8}$ alkyl group are most particularly suitable. Examples of such fatty acid esters are 2-ethylhexyl oleate, 2-ethylhexyl stearate and i-butyl oleate.

The present invention also relates to compositions preventing fatty spew which contain an oiling component and a fatty spew inhibiting additive, the fatty spew inhibiting additive being a nonionic organic dialkyl compound with a pour point below 6° C. which is selected from the group consisting of (a) fatty acid esters corresponding to general formula (I):

$$R^1—COO—R^2 \quad (I)$$

in which $R^1$ is an alkyl group containing 7 to 21 carbon atoms and $R^2$ is an alkyl group containing 1 to 22 carbon atoms, the alkyl groups optionally being saturated or unsaturated, linear or branched, with the proviso that at least one of the substituents $R^1$ or $R^2$ is unsaturated and/or branched and the total number of carbon atoms per ester molecule is in the range from 14 to 36, and/or (b) dialkyl ethers corresponding to general formula (II):

$$R^3—O—R^4 \quad (II)$$

in which $R^3$ and $R^4$ independently of one another represent an alkyl group containing 1 to 32 and, more particularly 7 to 22 carbon atoms, the alkyl groups optionally being saturated or unsaturated, linear or branched, with the proviso that the total number of carbon atoms per ether molecule is in the range from 14 to 36.

Compositions in which the oiling component is a neutral fat are preferred. In standard leather nomenclature, a neutral fat is any oiling and substantially water-insoluble substance. Examples of neutral oils are triglycerides, alkanes and fatty acids.

The present invention also relates to a process for oiling leather, in which tanned leather is treated with an oiling component and a fatty spew inhibiting additive, the fatty spew inhibiting additive used being a nonionic organic dialkyl compound with a pour point below 6° C. which is selected from the group consisting of (a) fatty acid esters corresponding to general formula (I):

$$R^1—COO—R^2 \quad (I)$$

in which $R^1$ is an alkyl group containing 7 to 21 carbon atoms and $R^2$ is an alkyl group containing 1 to 22 carbon atoms, the alkyl groups optionally being saturated or unsaturated, linear or branched, with the proviso that at least one of the substituents $R^1$ or $R^2$ is unsaturated and/or branched and the total number of carbon atoms per ester molecule is in the range from 14 to 36, and/or (b) dialkyl ethers corresponding to general formula (II):

$$R^3—O—R^4 \quad (II)$$

in which $R^3$ and $R^4$ independently of one another represent an alkyl group containing 1 to 32 and, more particularly 7 to 22 carbon atoms, the alkyl groups optionally being saturated or unsaturated, linear or branched, with the proviso that the total number of carbon atoms per ether molecule is in the range from 14 to 36.

In one preferred embodiment of the process according to the invention, a neutral fat is used as the oiling component. The process according to the invention is particularly suitable for the oiling of chrome-tanned leather.

In one particularly preferred embodiment of the process according to the invention, the additives used are nonionic organic dialkyl compounds which have a pour point below −10° C. and which are selected from the group of fatty acid esters (I) in which the substituent $R^2$ is a branched alkyl group containing 4 to 8 carbon atoms.

The oiling process is carried out in the usual way. In the course of the oiling process, the oil has to be transported into the capillary spaces present between the leather fibers and the fibrils and fibers and fibrils have to be uniformly coated with a fatty film. Apart from the hot-stuffing method, the oiling process is always carried out on moist leather because, in the moist state, the leather fibers are separated from one another by water. The oil thus penetrates slowly, but very uniformly into the moist leather.

Basically, the quantity of fats deposited in the leather is not subject to any particular limitations and is essentially determined by the particular type of leather. For example, vegetable-tanned sole leathers and insole leathers contain only a little fat (around 0.5 to 2%), while vegetable-tanned upper leather contains 15 to 23% of fats, drive belt leather 5 to 20% of fats, tack leather and some special industrial leathers 25% of fats or more. Chrome-tanned upper leather mostly contains only 2 to 6% of fats, chrome-tanned clothing leather containing slightly more fats (4 to 10%) and waterproof leather around 15 to 21% of fats.

In practice, the oiling of leather may be carried out simply by oiling the moist leather before drying and also by greasing the moist leather on the table ("cold oiling"), by oiling the moist leather in a milling drum ("hot oiling"), by hot-stuffing the dry leather and by treating the moist leather with an aqueous fatty emulsion, so-called fat liquoring. The last of these processes is of particular importance for chrome-tanned leathers. Accordingly, it is the preferred form of oiling in the context of the present invention.

The compounds corresponding to formulae (I) and (II) are prepared by syntheses known per se in organic chemistry. In addition, they are commercially available in many cases.

The extent to which fatty spew is suppressed by compounds (I) and (II) is original and novel by comparison with the cited prior art. The effectiveness of the compounds according to the invention is not based on individual parameters, such as pour point, but is attributable instead to the combination of all features. In this connection, reference is explicitly made to Table 3 of the Examples.

Compounds (I) and (II) according to the invention or mixtures thereof may be used in oiling preparations in quantities of 5 to 70% by weight and preferably in quantities of 5 to 30% by weight, based on the mixture as a whole.

The following Examples are intended to illustrate the invention without limiting it in any way.

EXAMPLES

1. Substances used

The Examples and Comparison Examples described under No. 2 and No. 3 were carried out on the basis of commercial products which are listed in Table 2.

TABLE 2

| Name | Chemical constitution | AS[1] (%) | Commercial product of |
|---|---|---|---|
| Chromosal B | Basic chromium sulfate | 33 | Bayer AG |
| Pellutax AW | Aromatic sulfonic acid condensate | 98 | BASF |
| Coratyl G | Na-Al silicate | 100 | Henkel |
| Sella Echt-schwarz FN | Black dye | 100 | Ciba Geigy |
| Drasil ANG | Polymer tanning agent | 40 | Henkel |
| Pellutax SWLF | Aromatic sulfonic acid condensate | 100 | BASF |
| Lederolinor NO | Mixture of native and synthetic fatty acid esters | 99 | Henkel |

[1]AS = Active substance

2. Preparation of the leather

Chrome-tanned wet blue with a thickness of 1.7 mm was used for all the tests. The individual process steps are shown in Table 3. The initial pH value of the liquor was 3.8. In Table 3, all percentages are based on the pared weight.

TABLE 3

| Process Step | % | Product/remarks | °C. | Running time |
|---|---|---|---|---|
| Washing | 200 | Water | 40 | 10 mins. |
| | | Drain off liquor | | |
| Retanning | 100 | Water | 40 | |
| | 3 | Chromosal B | | |
| | 3 | Pellutax AW | | |
| | 1.5 | Coratyl G | | 45 mins. |
| | | Drain off liquor | | |
| Dyeing | 100 | Water | 40 | |
| | 1 | Sella Echtschwarz FN | | 30 mins. |
| | +3 | Drasil ANG | | 15 mins. |
| | +3 | Pellutax SWLF | | 30 mins. |
| | | Drain off liquor | | |
| Oiling[1] | 100 | Water | 50 | |
| | 15 | Oiling component | | |
| | 5 | Additive | | 45 mins. |
| | +0.7 | Formic acid | | 30 mins. |

Hoard up leather overnight, stretch, dry in vacuo at 70° C. (2 mins.), hang to dry, dampen, stake

[1]Sulfated palm oil was used as the oiling component; it had been obtained in the usual way by reaction of 100 parts by weight of palm oil (iodine value range: 41–50; C chain distribution: C16 = 45–54%; C18 = 5–10%) with 18 parts by weight of conc. sulfuric acid. The oiling component was first mixed with the particular additive (cf. TABLE 4) and the resulting mixture emulsified in water.

3. Evaluation of fatty spew

The leathers pretreated in accordance with No. 2 were tested for their tendency to form fatty spew. The method used is a modification of the method developed by H. A. Ollert (cf. "Das Leder" 1989, page 256). The good correlation of the test results with the results of long-term storage which Ollert mentioned were confirmed in our own tests. In particular, it was found that the favorable effect of additives known from the prior art, such as chlorinated paraffins, is picked up and confirmed in the test. More specifically:

The leather to be tested (pretreated in accordance with No. 2) was punched out in the shape of disks (155 mm in diameter) without conditioning. The opening of a 1 liter face-ground beaker (external diameter: 155 mm) filled with 300 ml of tapwater was then covered with these leather disks, the grain side being on top (outside). The leather was fixed with a clamping ring, after which the water was brought to the boil and kept boiling for 2 minutes. In this way, the pretreated leather was subjected to a predetermined thermal load, steam escaping from the scars. The clamping ring was then removed, the leather disk covering the face-ground beaker was taken off and the water was poured out. The droplets of water adhering to the walls of the beaker after the water had been poured out were left in the beaker, i.e. the glass was not additionally dried. The leather still moist from the steam treatment described above was then immediately transferred to the face-ground beaker which was then sealed with a glass disk. The leathers were then stored in the sealed beaker for 5 days at a temperature of 25° C. Thereafter, the leather was visually examined for fatty spew.

The tests were repeated 10 times for each additive. The results are set out in Table 4.

It was found that, where the pure oiling component (comparison C1) was used, 80% of the leather showed fatty spew. Comparisons C2 to C4 clearly show that, where comparison fatty acid esters are used as additives, fatty spew is of the same order; even with linolenic acid triglyceride (comparison C4), where only 30% of the leather showed fatty spew, the situation was totally unsatisfactory from the point of view of avoiding fatty spew.

By contrast, all the Examples based on the additives according to the invention (tests E1 to E5) were free from fatty spew.

TABLE 4

| Test | Additive | Number of leathers: With fatty spew | Number of leathers: Without fatty spew |
|---|---|---|---|
| C1 | – | 8 | 2 |
| C2 | Lederolinor No | 7 | 3 |
| C3 | Octanoic acid methyl ester | 6 | 4 |
| C4 | Linolenic acid tri-glyceride | 3[a] | 7[a] |
| C5 | Chlorinated paraffin[b] | 0 | 10 |
| E1 | 2-Ethylhexyl oleate | 0 | 10 |
| E2 | 2-Ethylhexyl stearate | 0 | 10 |
| E3 | i-Butyl oleate | 0 | 10 |
| E4 | Di-n-octyl ether | 0 | 10 |
| E5 | Di-2-ethylhexyl ether | 0 | 10 |

[a]Leather resinified

[b]Additive known from the prior art, but unsuitable because of its halogen content

We claim:

1. A process for oiling leather comprising contacting a leather substrate with a fatty spew inhibiting composition comprising an oiling component in combination with a dialkyl ether additive having a pour point below 6° C., said additive corresponding to general formula II:

$$R^3—O—R^4 \quad (II)$$

wherein $R^3$ and $R^4$, independently of one another represent an alkyl group containing 1 to 32 carbon atoms, said alkyl group being saturated or unsaturated, linear or branched, said dialkyl ether additive having a total number of carbon atoms per ether molecule in the range from 14 to 36.

2. The process of claim 1 wherein said alkyl group contains from 7 to 22 carbon atoms.

3. The process of claim 1 wherein said dialkyl ether additive has a pour point below −10° C.

4. The process of claim 1 wherein said oiling component is a neutral fat.

5. The process of claim 4 wherein said neutral fat is selected from the group consisting of triglycerides, alkanes, and fatty acids.

6. The process of claim 1 wherein said dialkyl ether additive is present in an amount from 5 to 70% by weight, based on the weight of the composition.

7. The process of claim 1 wherein said dialkyl ether additive is present in an amount from 5 to 30% by weight, based on the weight of the composition.

8. The process of claim 1 wherein said contacting step is performed by cold oiling said leather.

9. The process of claim 1 wherein said contacting step is performed by fat liquoring said leather.

10. The process of claim 1 wherein said contacting step is performed by hot oiling said leather.

11. The process of claim 1 wherein said leather comprises tanned leather.

12. The process of claim 1 wherein said leather comprises chrome-tanned leather.

* * * * *